United States Patent [19]

Marechal

[11] 3,982,808

[45] Sept. 28, 1976

[54] SINGLE WIRE ELECTRICAL CONNECTOR

[75] Inventor: Gilles Marechal, Paris, France

[73] Assignee: Societe d'Exploitation des Procedes Marechal S.E.P.M. (Societe Anonyme), Paris, France

[22] Filed: May 7, 1975

[21] Appl. No.: 575,367

[30] Foreign Application Priority Data

May 9, 1974 France ..... 74.16068

[52] U.S. Cl. ..... 339/88 R; 339/90 R; 339/188 C

[51] Int. Cl.[2] ..... H01R 7/32; H01R 13/54

[58] Field of Search ..... 339/88 R, 90, 188 R, 339/188 C, 189 R, 190, 76–79, 82, DIG. 2; 403/315, 321, 322, 325; 24/211 R, 221 R

[56] References Cited

UNITED STATES PATENTS

| | | | |
|---|---|---|---|
| 1,101,289 | 6/1914 | Knauff | 339/188 R X |
| 1,505,821 | 8/1924 | Thomas | 339/88 R |
| 2,729,800 | 1/1956 | Knudsen | 339/188 C |

FOREIGN PATENTS OR APPLICATIONS

| | | | |
|---|---|---|---|
| 505,161 | 7/1920 | France | 339/88 R |
| 272,670 | 6/1927 | United Kingdom | 339/82 |
| 9,821 | 4/1903 | United Kingdom | 339/82 |
| 9,194 | 4/1909 | United Kingdom | 339/81 |

*Primary Examiner*—Roy Lake
*Assistant Examiner*—Craig R. Feinberg
*Attorney, Agent, or Firm*—Edwin E. Greigg

[57] ABSTRACT

A connector for connecting two lengths of electric cable, especially of high current capabilities, comprising a male terminal or plug, traversed by a pin, and a female terminal or socket carrying a sleeve freely rotatable thereon but resiliently urged longitudinally toward the end of the socket by a resilient means on the socket. When inserted in the socket, the contacting surfaces on both plug and socket are positively engaged and a rotation of the sleeve further interlocks the pin and sleeve by increasing the resilient load of the resilient means by a slight relative longitudinal displacement of the sleeve resulting from the rotation thereof. This connector ensures a highly efficient electrical contact between the cable ends and eliminates all risk of accidental disconnection.

8 Claims, 5 Drawing Figures

SINGLE WIRE ELECTRICAL CONNECTOR

BACKGROUND OF THE INVENTION

This invention relates to connectors for joining the ends of two lengths of electric cable, such as employed for large diameter cables for carrying very high current which may exceed 1,000 amperes. These single wire connectors are well-known and are often called "welded connectors" simply because, at first, such current transporting cables were joined by electric welding.

The connectors known to the present consist of a male terminal or plug attached to one end of an electric cable and a female terminal or socket attached to the other. Connection is effected by the insertion of the male terminal or plug into the female terminal or socket, and partially rotating one of the terminals so that a bayonet connection on one of the terminals is utilized. This forces a contact surface or frontal face on one terminal into contact with a similar contact surface or frontal face on the other terminal. It is clear, however, that such a connector, which consists only of a plug and a socket held together by a bayonet connection, does not ensure high quality or efficient electrical contact and that any play, slight as it may be, between the contact surfaces produces unacceptable heating, given the high currents employed.

A significant improvement in the quality of the connectors and the contact between the surfaces has been attained by equipping the female terminal with a spring-biased contact surface and providing the bayonet connection with a guide ramp for the plug when inserted in the socket so as to load the spring and thus resiliently urge the two contacts together in the course of the rotational movement of the bayonet connection. There is, however, one difficulty or weakness which arises, particularly where high currents are utilized and that is the movable spring-bias contact has a tendency to heat up and make is generally unacceptable.

Finally, in all the prior art connectors, the simple handling of the connected cable very often involved an accidental unlocking of the bayonet connection and a separation of the terminals. This disconnection occurred more often with larger cable with its greater inertia. As a matter of fact, this shortcoming is so well-known that it is utilized by workmen to effect a quick separation of the terminals without the necessity of taking hold of the connector itself when a line is being dismantled or disconnected.

SUMMARY OF THE INVENTION

In order to avoid the aforementioned shortcomings while still preserving the advantages accruing from a resilient or spring-biased front face or contacts in connectors, this invention provides for a connector in which the two terminals carry matched means for preventing relative rotation therebetween, together with a sleeve which locks the matched means together against the load of the spring bias so that the frontal faces or contact surfaces make a good electrical connection between the two cables.

A diametrically disposed protruding pin, carried by the plug, constitutes one of the matched means for preventing relative rotation between the plug and socket and the other matched means being two diametrically opposed slots in the lateral or side walls of the sleeve of the socket. The insertion of the plug into the socket is effected freely until the contact surface of the plug abuts against the similar contact surface of the socket. At this time, the sleeve, freely rotatable on the socket having means for guiding the pin, pulls the ends of the plug and socket together, while the sleeve is rotated relative to the plug and socket. At least one resilient means, such as a spring, is disposed on either the plug or socket for opposing the slight longitudinal displacement or pulling the ends of the plug and socket together and upon completion of rotation of the sleeve, the pin is located in locking holes and held there by the resilient means.

BRIEF DESCRIPTION OF THE DRAWINGS

The invention will be better understood and further advantages will become apparent from the reading of the description of a preferred form of embodiment of the invention which follows and from the examination of the attached drawings in which the figures, all perspective views, respectively represent.

BRIEF DESCRIPTION OF THE PREFERRED EMBODIMENT

Figure 1:
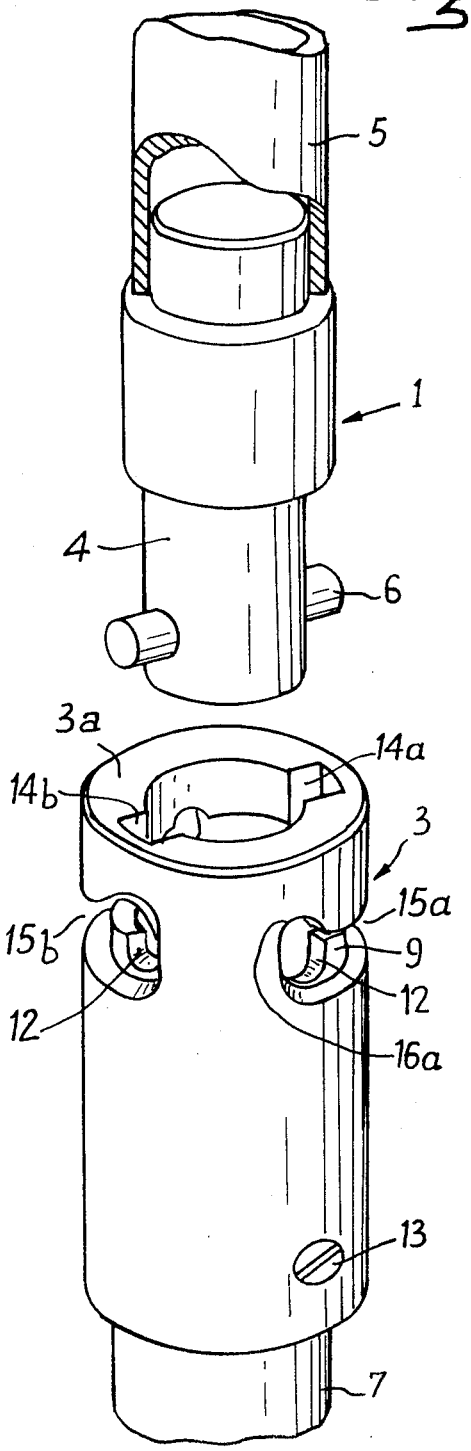
FIG. 1: the two terminals facing one another before connection.
Figure 2:
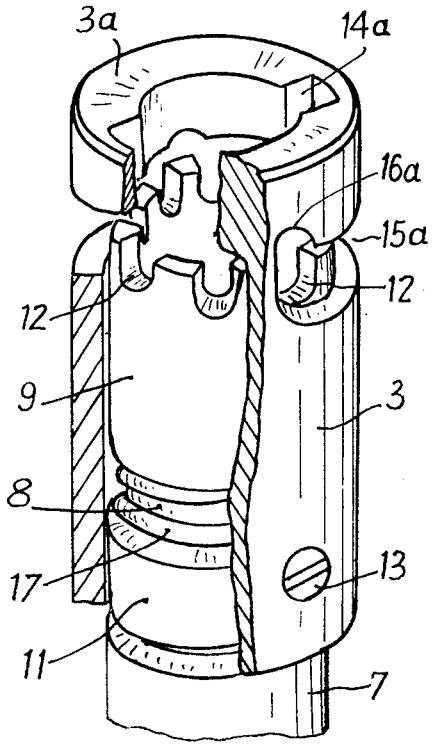
FIG. 2: the female terminal with its sleeve partly cut away.

It must be noted that for greater clarity, the three parts of the connector, that is to say, the two terminals and the sleeve, are shown without their insulating casings; but that in practice each one of them is furnished with a sheath or casing of a synthetic insulating material fixed by screws of a similar insulating material; that these casings are inserted one into another with an overlap adequate to avoid any accidental external contact; that they carry on their outer surfaces or walls longitudinal ridges or serrations ensuring a good grip for effecting their relative rotation; and that, finally, the sheaths of the male and female terminals extend well beyond the free edges of the terminal casings, these extensions offering an internal diameter adequate to receive the end of the covering of the cable.

The connector is constituted by a male terminal 1, a female terminal 2 and a sleeve 3, all of an electrically conducting material, such as copper.

The male terminal 1 incorporates a conventional contact head 4 extended by a casing terminal 5 which receives the bared end of the conductor of the cable (not shown). A pin 6 passes transversely through the head 4 and protrudes beyond the circumference thereof adjacent to its frontal end or contact surface.

Figure 4:
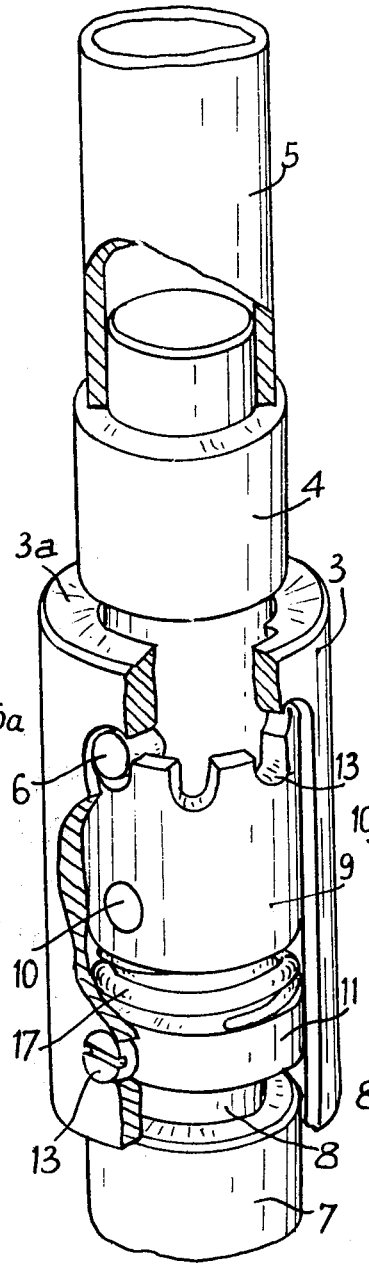
FIG. 4: the two terminals in the same position as in FIG. 3, but with the sleeve partly cut away for purposes of clarity.
Figure 5:
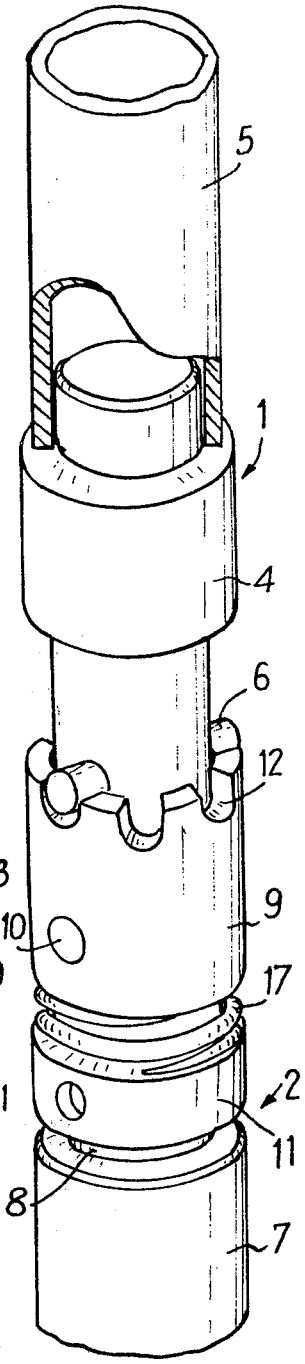
FIG. 5: the two terminals in contact, the sleeve being removed for purposes of clarity.

The female terminal 2 incorporates a terminal casing 7 integral with a plug 8 terminating in a heat 9 forming the socket and comprising, in the example shown, a tubular portion inserted onto the end of the plug 8 and immobilized by a pin 10 (FIGS. 4 and 5). On the plug 8 between the terminal casing 7 and the head 9, is a freely rotatable ring 11, while on the free edge of the head 9 opposite the ring 11 are a number of slots 12, six in the example shown, arranged in diametrically opposite pairs.

The sleeve 3 is slipped onto the end of the female terminal, that is to say, it covers the head 9, the plug 8 and the adacent end of the terminal casing 7. Sleeve 3 is fixed to the ring 11 by at least one screw 13, and it is thus freely rotatable relative to the terminal casing 7 and the head 9. The free end of the sleeve opposite the ring 11 extends beyond the free end of the head 9 and is terminated by a frontal wall 3*a* and is provided with a circular port or hole, the diameter of which corresponds to that of the end of the head 4 of the male terminal. This frontal wall also is provided with two radial slots 14*a*, 14*b* diametrically opposite to one another, opening into the port or aperture and matched to the extended parts of the pin 6 and forming guidance means for head 4 and pin 6. On the lateral surface or wall of the sleeve 3, there is provided two windows or locking slots 15*a*, 15*b* which extend in a transverse direction. The edges of the windows nearest the terminal casing 7 are disposed at the level of the base of the slots 12 and their opposite edges each form a smooth and gentle ramp running respectively to the right of the notches 14*a*, 14*b* and becoming progressively further from the front wall 3*a* to be terminated by a re-entrant curve or locking hole, such as 16*a*.

Lastly, a helical spring 17 surrounding the plug 8 is interposed between the ring 11 and the head 9 of the female terminal under a predetermined compression loading.

The functioning of the device will now be described. In order to effect the connection, the head of the male terminal 1 is inserted through the port of the front wall 3*a* of the sleeve 3 with the pin 6 oriented to enter the radial slots 14*a* and 14*b*. A small amount of rotation (30° maximum in the example shown) in one direction or the other, causes the extending ends of pin 6 to enter one of the pairs of slots 12 (see in particular FIG. 5), so immobilizing the two terminals against relative rotation. It should be noted, on the one hand, that during the aforesaid rotation for positioning of the pin 6 in slots 12, the sleeve, being freely rotatable, follows the movement without resistance and that, on the other hand, the plurality of the slots 12 makes it possible to limit the maximum rotation necessary. This factor is extremely useful in view of the inertia and the resistance to torsion of large diameter cables.

The depth of the socket formed by the head 9 is such that the front face or contact surface of the contact head 4 of the male terminal becomes abutted against the base or front face (contact surface) of the said socket before the pin 6 can reach the bottom of the slots 12 (FIG. 5). That is to say, the pin 6 will not seat in the slots 12. At this moment, the extending ends of the pin 6 have passed completely through the front wall 3*a* of the sleeve and are located in the windows 15*a*, 15*b* at the start of the ramps where the breadth of the windows 15*a*, 15*b* is the greatest.

Figure 3:
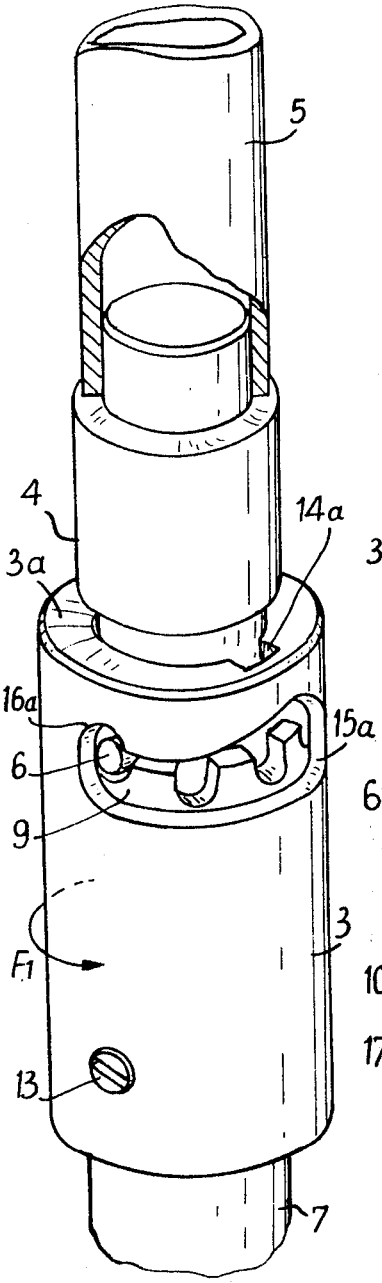
FIG. 3: the two terminals connected after completion of the rotation of the sleeve.

It then suffices to impart a rotational movement to the sleeve 3 in the direction of the arrow F1 (FIG. 3). The ramps described earlier and formed by the frontal edge of the windows 15*a*, 15*b* tend to sink or move the male terminal more deeply into the female terminal by acting upon the pin 6 effecting a slight longitudinal displacement of the sleeve 3, and consequently of the ring 11, against the action of the spring 17 increasing compression loading of the spring. When the ends of the pin 6 arrive opposite the re-entrant curves 16*a*, the sleeve partially moves toward its initial position because of the action of spring 17 and the ends of the pin are then held in the concavity of the said re-entrant curves (FIGS. 3 and 4). Thus, a resilient locking is achieved which can only be unlocked by applying a torque to the sleeve 3 (the inverse of F1), the value of which torque is a function of the gradient between the curve 16*a* with the ramp 15*a*.

Thus, a connector comprising the invention preserves the advantages of the resilient or spring-biased contacts of the prior art since the surfaces in contact (front face of the head 4 and base or contact surface of the head 9) are forced against each other under bias of the compression spring 17 which is a function of the initial loading of the spring plus the additional loading imposed because of the difference of level between the bottom of the re-entrant curves 16*a* and the origin of the ramps of the windows 15*a*, 15*b*. In addition, an accidental disconnection is no longer a problem because of the resilient locking accomplished by the sleeve 3 and pin 6, and above all, because of the fact that the unlocking cannot be attained through a relative rotation of the two terminals and cables but only through a rotation of the sleeve which is not rotationally fixed to either the male or the female terminals.

Of course, it is possible to apply modifications to the embodiment disclosed without departing from the scope of the invention. It is, for example, thus possible to vary the means for preventing relative rotation between the two terminals by providing the male head 4 and the female head 9 with matched polygonal sections instead of the slots 12. Also, the spring 17 may be replaced by a spring washer, and grooves formed in the internal face of the sleeve 3 may be substituted for the windows 15*a*, 15*b*. But one interesting variant of the resilient locking means is deserving of mention. The relative longitudinal displacement of the sleeve 3 corresponding to the amplitude of the deformation of the resilient means is very slight, it can be kept to around 3 mm. In these conditions, the spring 17 can be eliminated and the function thereof may be accomplished by replacing the pin 6 and the solid pin 10 with resilient split pins or keys. It would equally be possible to provide two resilient split keys diametrically opposed to lock the sleeve 3 and the ring 11 in rotation in lieu of the screw 13.

Finally, it is noted that in this invention the advantage of the resilient socket type contact of the prior art is preserved without the disadvantage of heating as aforesaid, since the cross-section of the cables is not lessened in any way to accommodate the resilient means.

I claim:

1. A connector for joining two lengths of electrical high current cables together including a male terminal on the end of one cable and a female terminal on the end of the other cable, said male terminal including a front face for engagement with a front face on said female terminal to provide electrical contact between said two cables, and matching means for engaging complementary matching means on said female terminal for preventing relative rotation between said terminals, said female terminal comprising a socket with a front face for engaging said front face on said male terminal upon insertion of the male terminal into the female terminal and incorporating matching means for engaging the matching means on said male terminal, a sleeve freely rotatably mounted upon said female terminal and incorporating means tending to cause longitudinal relative movement of said cables toward one another upon rotation of said sleeve, thus causing longitudinal displacement of said sleeve toward said male terminal, and resilient means opposing said longitudinal displacement of said sleeve thereby supplementing the function of said matching means to prevent relative rotation of said cables.

2. The connector as claimed in claim 1 wherein the matching means on said male terminal comprises a transverse pin spaced a distance from said front face and extending beyond the outer periphery of said cable, wherein the matching means on said female terminal comprises pairs of diametrically opposed notches formed on the front edge of said socket and adapted to receive said pin in one of said pairs upon insertion of said male terminal into said female terminal.

3. A connector as claimed in claim 2 wherein said sleeve further includes means for guiding said pin toward said notches and further includes ramp means diametrically opposite one another and extending transversely of said sleeve and receding progressively away from the cable of said female terminal so that rotation of said sleeve increases the load of said resilient means.

4. The connector as claimed in claim 3 wherein said female terminal includes a ring freely rotatable thereabout and means for fixing said sleeve to said ring.

5. The connector as claimed in claim 4 wherein said resilient means comprises a helical spring disposed between said ring and the end of the female terminal and under a predetermined loading.

6. A connector for joining two lengths of electrical high current cables together including a male terminal on the end of one cable and a female terminal on the end of the other cable, said male terminal further including a front face for engagement with a front face on said female terminal to provide electrical current between said two cables, transversely projecting pin means extending beyond the cable arranged for initial entry through the front wall of a freely rotatable sleeve member associated with an annulus mounted on the female terminal, said pin means after said entry into said sleeve being received in a socket head provided with plural pairs of recesses, said sleeve member and said annulus being held in spaced relation by an elastic member, said sleeve member further including oppositely disposed elongated means defining openings therein, each of which includes retention means adjacent to at least one end of said openings, and said retention means cooperating with said pin means to effect longitudinal displacement of said sleeve and said annulus against the action of the elastic member.

7. A connector as claimed in claim 6, in which said elongated means defining openings in said sleeve member further includes ramp means extending transversely of said opening on one wall thereof with said ramp terminating abruptly into said retention means.

8. A connector as claimed in claim 6, in which said elastic member comprises a helical spring.

* * * * *